US008068632B2

(12) United States Patent
Inaoka et al.

(10) Patent No.: US 8,068,632 B2
(45) Date of Patent: Nov. 29, 2011

(54) MICROPHONE AND MICROPHONE HANGER-HOOK

(75) Inventors: Keijirou Inaoka, Osaka (JP); Kazuya Syudou, Osaka (JP); Yasuhisa Aikawa, Osaka (JP)

(73) Assignee: Icom Incorporated (JP)

( * ) Notice: Subject to any disclaimer, the term of this patent is extended or adjusted under 35 U.S.C. 154(b) by 486 days.

(21) Appl. No.: 12/393,711

(22) Filed: Feb. 26, 2009

(65) Prior Publication Data

US 2009/0220117 A1 Sep. 3, 2009

(30) Foreign Application Priority Data

Feb. 29, 2008 (JP) ..... 2008-050769
Sep. 30, 2008 (JP) ..... 2008-253092

(51) Int. Cl.
*H04R 11/04* (2006.01)
*H04R 17/02* (2006.01)
*H04R 19/04* (2006.01)

(52) U.S. Cl. ..... 381/361; 381/366

(58) Field of Classification Search ..... 381/361, 381/366
See application file for complete search history.

(56) References Cited

U.S. PATENT DOCUMENTS 4,088,848 A * 5/1978 Weed ..... 248/314
7,099,487 B2 * 8/2006 Fukuda ..... 381/362

FOREIGN PATENT DOCUMENTS

JP 09-037373 2/1997
JP 2001-160993 6/2001
JP 2003-224897 8/2003

* cited by examiner

*Primary Examiner* — Tu-Tu Ho
(74) *Attorney, Agent, or Firm* — Baker & McKenzie LLP

(57) ABSTRACT

A conductive hanger plate having a flat external face and a conductive hanger knob are so provided as to be electrically isolated with each other at the same side of the external face of a non-conductive rear casing of a microphone casing. A conductive hanger hook hanging the microphone casing via the hanger knob is provided with a notch for catching the hanger knob. The hanger hook has a first elastic member which pushes the caught hanger knob in a direction toward a hanger face, and second elastic members which urges the hanger plate in a direction apart from the hanger face.

11 Claims, 10 Drawing Sheets

MICROPHONE AND MICROPHONE HANGER-HOOK

RELATED APPLICATION

This application is based on Japanese Patent Application No. 2008-050769 filed on Feb. 29, 2008 and Japanese Patent Application No. 2008-253092 filed on Sep. 30, 2008 and including each specification, claims, drawings and summary. The disclosure of the above Japanese Patent Applications is incorporated herein by reference in their entirety.

BACKGROUND OF THE INVENTION

1. Field of the Invention

The present invention relates to a microphone of a communication device and a microphone hanger-hook.

2. Description of the Related Art

Conventionally, as a hanger-switch which detects that a microphone is hanged on a hanger-hook, there is a device that comprises a microphone having a circuit board for detection and a conductive hanger knob, and a grounded metallic hanger hook. Such a hanger-switch detects that the microphone is hanged on the hanger-hook as the circuit board is electrically connected to the hanger-hook via the hanger knob.

According to the foregoing microphone hanger-switch, a wiring that extends from the hanger-hook and causes the hanger-hook to be grounded is obstructive. Moreover, when the hanger-hook is disposed, the wiring becomes bothersome. Accordingly, the following literatures disclose microphones which have no such a wiring so as to avoid the occasion where a wiring is obstructive and bothersome.

For example, Unexamined Japanese Patent Application KOKAI Publication No. H9-37373 discloses a microphone hanger-switch having a circuit board that the first contact point thereof is electrically connected to a hanger plate via a spring pin which pushes the first contact point, and the second contact point of that circuit board is electrically connected to a hanger knob via a plate spring which pushes the second contact point. Such a structure enables omission of a soldering process when a microphone is assembled. Moreover, according to such a structure, when the microphone is subjected to maintenance, the rear casing of the microphone can be completely apart from the front casing.

Moreover, Unexamined Japanese Patent Application KOKAI Publication No. 2003-224897 also discloses a microphone hanger-switch comprising a hanger plate member. The hanger plate member comprises a hanger spring having a spherical and elastic pushing member protrudingly formed at each arm in a substantially cross-like shape, and a hanger plate main body for protecting a microphone against any shocks. As the microphone is hanged on a hanger hook, at least two contact points among four contact points of the hanger plate member contact the hanger hook. Therefore, the feeling when the microphone is hanged on the hanger hook and the durability are improved.

Furthermore, Unexamined Japanese Patent Application KOKAI Publication No. 2001-160993 discloses a microphone hanger-switch having a spring plate protruding from the surface of a hanger plate. According to such a structure, when a microphone is hanged on a metallic engagement member provided in a vehicle or the like, the microphone is fastened. Accordingly, against sudden vibration, the possibility that the microphone is released from the engagement member is little.

However, the foregoing conventional technologies have the following problems.

The shape of the hanger plate is complicated in the microphone hanger-switches disclosed in both Unexamined Japanese Patent Application KOKAI Publications No. 2003-224897 and No. 2001-160993. In particular, because the hanger plate of Unexamined Japanese Patent Application KOKAI Publication No. 2003-224897 is comprised of two parts, it takes a cost to prepare separate dies used for manufacturing the hanger plate. Moreover, the hanger plate is provided with protrusive members, such as the elastic pushing member and the spring plate. Accordingly, there are problems that a person who holds the microphone with his/her hand has a feeling of a foreign body, and the degree of freedom for the designing of the microphone is limited.

SUMMARY OF THE INVENTION

The present invention has been made in view of the foregoing problems, and it is an object of the present invention to provide a microphone and a microphone hanger-hook which have no need of a ground wiring.

To achieve the object, a microphone according to the first aspect of the present invention comprises:

a non-conductive microphone casing;

a conductive hanger plate provided on the external face of the microphone casing;

a conductive hanger knob provided at the microphone casing so as to be electrically isolated from the hanger plate;

a conductive hanger hook for hanging the microphone casing via the hanger knob;

a hanger member having a notch that catches the hanger knob together;

a first elastic member that urges the hanger knob caught by the notch in a direction pushing back toward the hanger member; and a second elastic member that urges the hanger plate in a direction apart from the hanger member when the hanger knob is caught by the notch.

The second elastic member may be so provided as to protrude from a hole formed in the hanger member, and may contact the hanger plate via the hole.

The first and second elastic members may be respectively conductive blade springs.

The hanger knob may have a recess formed at the leading end, and the blade spring constituting the first elastic member may have a protrusion that engages with the recess.

The microphone may further comprise:

a circuit board provided inside the microphone casing;

a first conductive member that electrically connects the hanger knob and a first contact point on the circuit board; and a second conductive member that electrically connects the hanger plate and a second contact point on the circuit board.

The circuit board may have a determination unit that determines whether or not the microphone is hanged on the hanger knob on the basis of the voltage at the first contact point or the voltage at the second contact point.

The first conductive member may comprise:

a wiring that connects the first contact point of the circuit board and a terminal provided inside the microphone casing; and a conductive screw that connects the terminal and the hanger knob as the screw is fastened with the hanger knob via a hole provided in the microphone casing.

The second conductive member may comprise:

a conductive weight provided inside the microphone casing;

a first conductive screw that connects the circuit board and the weight as the first screw is fastened with the weight via a screw hole provided in the second contact point of the circuit board; and a second conductive screw that connects the hanger plate and the weight as the second screw is fastened with the weight via a screw hole provided in the hanger plate and a hole provided in the microphone casing.

The second conductive member may be a conductive spring that passes all the way through a hole formed in the microphone casing, and when the spring is compressed, one end of the spring may abut the second contact point of the circuit board, and the other end may abut the hanger plate.

To achieve the object, a conductive microphone hanger-hook according to the second aspect of the present invention is the hanger hook for hanging a microphone via a hanger knob and for electrically connecting the hanger knob and a hanger plate disposed at the microphone, the hanger hook comprising:

a hanger member having a notch that catches the hanger knob together;

a first elastic member that urges the hanger knob caught by the notch in a direction pushing back toward the hanger member; and a second elastic member that urges the hanger plate in a direction apart from the hanger member when the hanger knob is caught by the notch.

The second elastic member may be so disposed as to protrude from a hole formed in the hanger member, and may contact the hanger plate via the hole.

According to the present invention, there is provided a microphone and a microphone hanger-hook which have no need of a ground wiring.

BRIEF DESCRIPTION OF THE DRAWINGS

The object and other objects and advantages of the present invention will become more apparent upon reading of the following detailed description and the accompanying drawings in which.

DETAILED DESCRIPTION OF THE PREFERRED EMBODIMENTS

Explanations will be given of microphones and hanger hooks according to the embodiments of the present invention with reference to accompanying drawings.

First Embodiment

Figure 1:
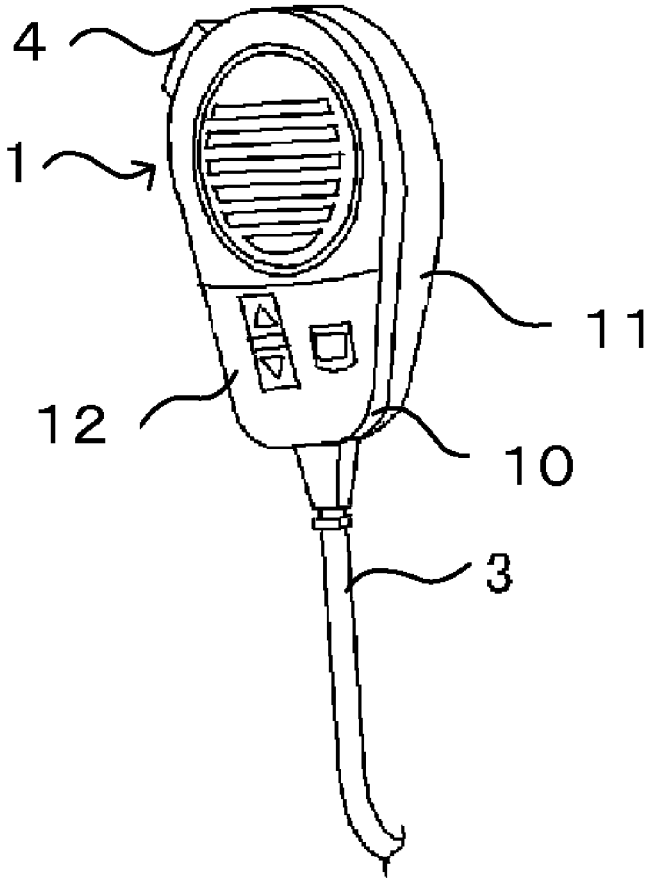
FIG. 1 is a diagram showing the external contour of a microphone according to a first embodiment.

FIG. 1 is a diagram showing the external contour of a microphone according to the first embodiment. As shown in FIG. 1, a microphone 1 is connected to a non-illustrated communication device main body via a cord 3. The microphone 1 becomes communicationable when a press-talk switch 4 provided at the side face of a microphone casing 10 comprised of a front casing 12 and a rear casing 11 is pressed.

Figure 2:
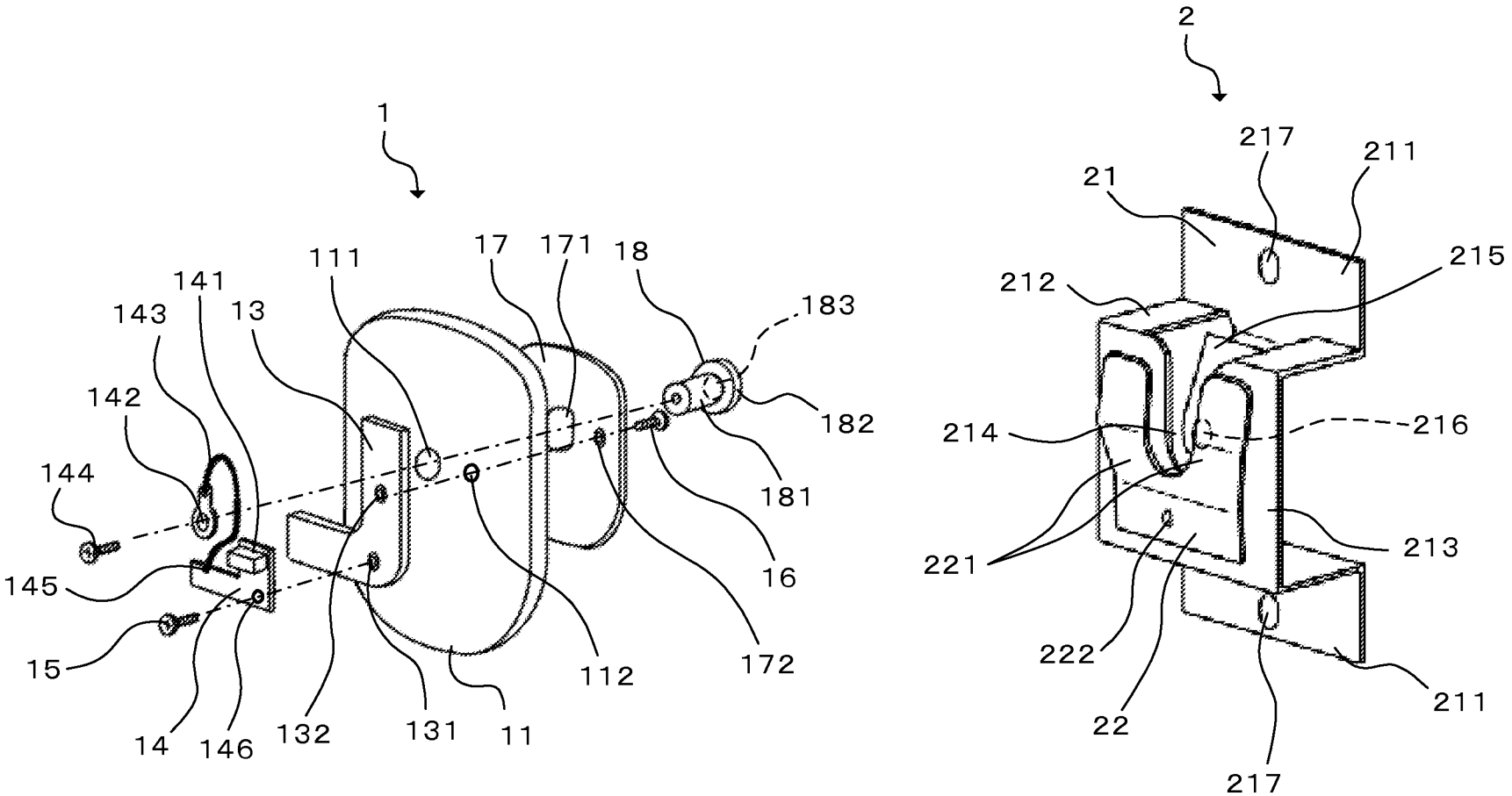
FIG. 2 is a perspective view showing the microphone and a hanger hook according to the first embodiment.

FIG. 2 is a perspective view showing the exploded microphone 1 and a hanger hook according to the first embodiment.

First, the structure of the microphone 1 will be explained. As shown in FIG. 2, the microphone 1 without the front casing 12 has the rear casing 11, a weight 13, a circuit board 14, two screws 15, 16, a hanger plate 17, and a hanger knob 18.

The rear casing 11 is formed of a non-conductive material, and has holes 111, 112 where screws 144, 16 are inserted. The screw 144 is to be discussed later.

The weight 13 is formed of a tabular metal. The weight 13 is provided to accomplish a massive feeling, and is attached to the front face of the rear casing 11. The weight 13 has holes 131, 132 where the screws 15, 16 are inserted.

The circuit board 14 is attached to the rear casing 11 via the weight 13. The circuit board 14 has a connector 141 to be connected to an external power source and to transmit a signal from the microphone. A lug terminal 142 is electrically connected to a first contact point 145 of the circuit board 14 via a hanger line 143. Further, the conductive screw 144 to be inserted in the lug terminal 142 is inserted in the hole 111 of the rear casing 11, and is threaded with the hanger knob 18. Accordingly, the lug terminal 142 is electrically connected to the hanger knob 18. Moreover, a screw hole where the screw 15 is inserted is formed in a second contact point 146 which constitutes a part of a hanger-switch circuit.

The screws 15, 16 are conductive. The screw 15 is inserted in the hole formed in the second contact point 146 of the circuit board 14 and the hole 131 formed in the weight 13, and threaded with the weight 13, thereby coupling the circuit board 14 and the weight 13. The screw 16 is inserted in a hole 172 formed in the hanger plate 17, the hole 112 formed in the rear casing 11, and the hole 132 formed in the weight 13, and is threaded with the weight 13, thereby coupling the hanger plate 17 and the weight 13. Accordingly, the second contact point 146 is electrically connected to the hanger plate 17 via the screws 15, 16, and the weight 13.

The hanger plate 17 is formed of a flat conductive material, and is attached to the rear face of the rear casing 11. The hanger plate 17 has a hole 171 having a larger diameter than the external diameter of a shaft portion 181 of the hanger knob 18. The hole 171 is located at a position which overlaps the hole 111 of the rear casing 11 when the hanger plate 17 is attached to the rear casing 11.

The hanger knob 18 is made of metal, and has the shaft portion 181, and a flange portion 182 facing the hanger plate 17. The external diameter of the shaft portion 181 is smaller than the diameter of the hole 171 of the hanger plate 17, so that the hanger knob 18 is inserted in the hole 171 without contacting the hanger plate 17. Accordingly, the hanger knob 18 is electrically isolated from the hanger plate 17, and is fixed to the rear face of the rear casing 11 by the screw 144. The flange portion 182 has a recess 183 which engages with a protrusion 216 formed at a first elastic member 215 of the hanger hook 2 to be discussed later.

Figure 3:
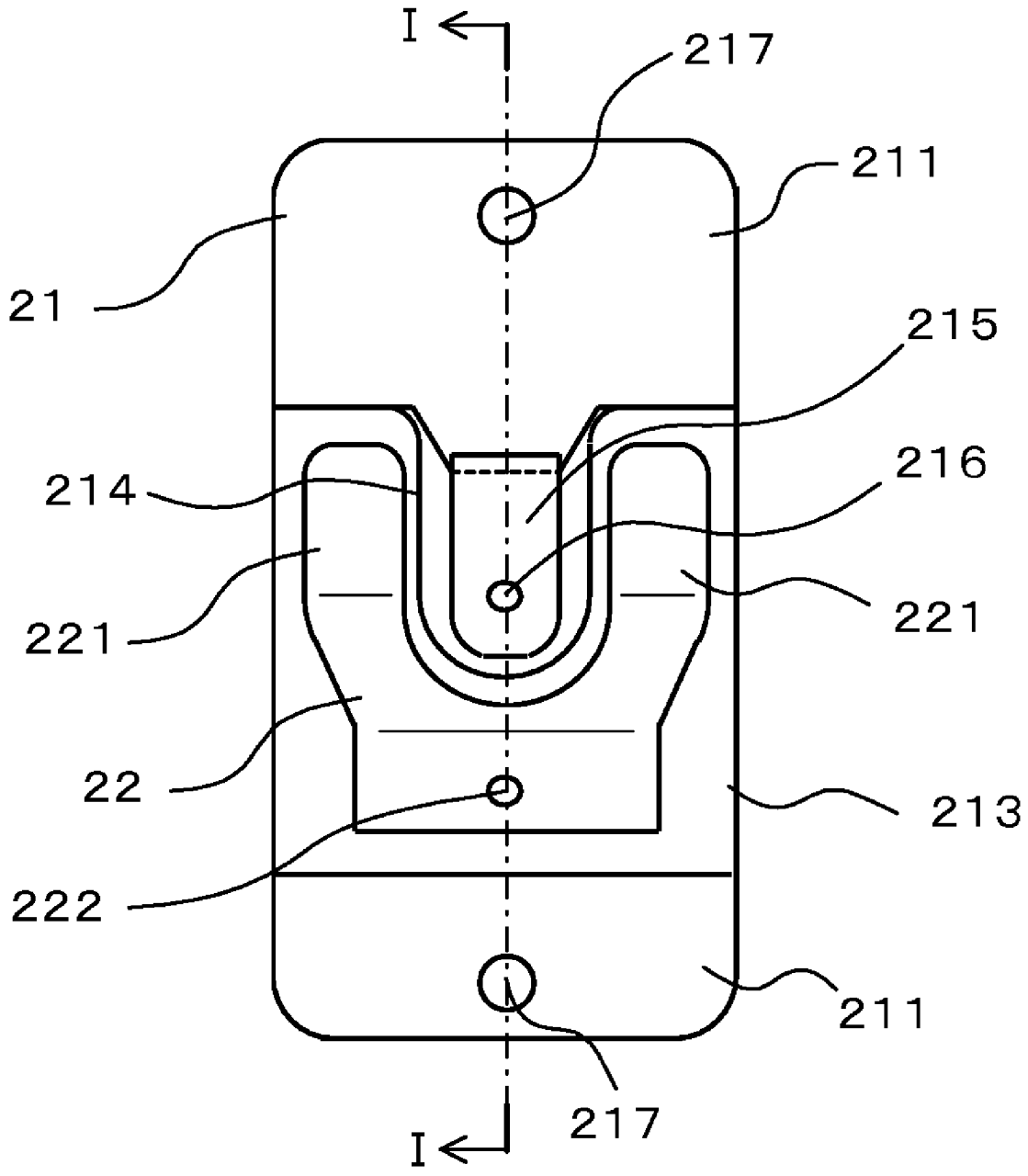
FIG. 3 is a front view showing the hanger hook according to the first embodiment.

Next, the structure of the hanger hook 2 will be explained. FIG. 3 is a front view of the hanger hook 2. As shown in FIGS. 2 and 3, the hanger hook 2 has a base portion 21 and a spring portion 22.

Figure 4:
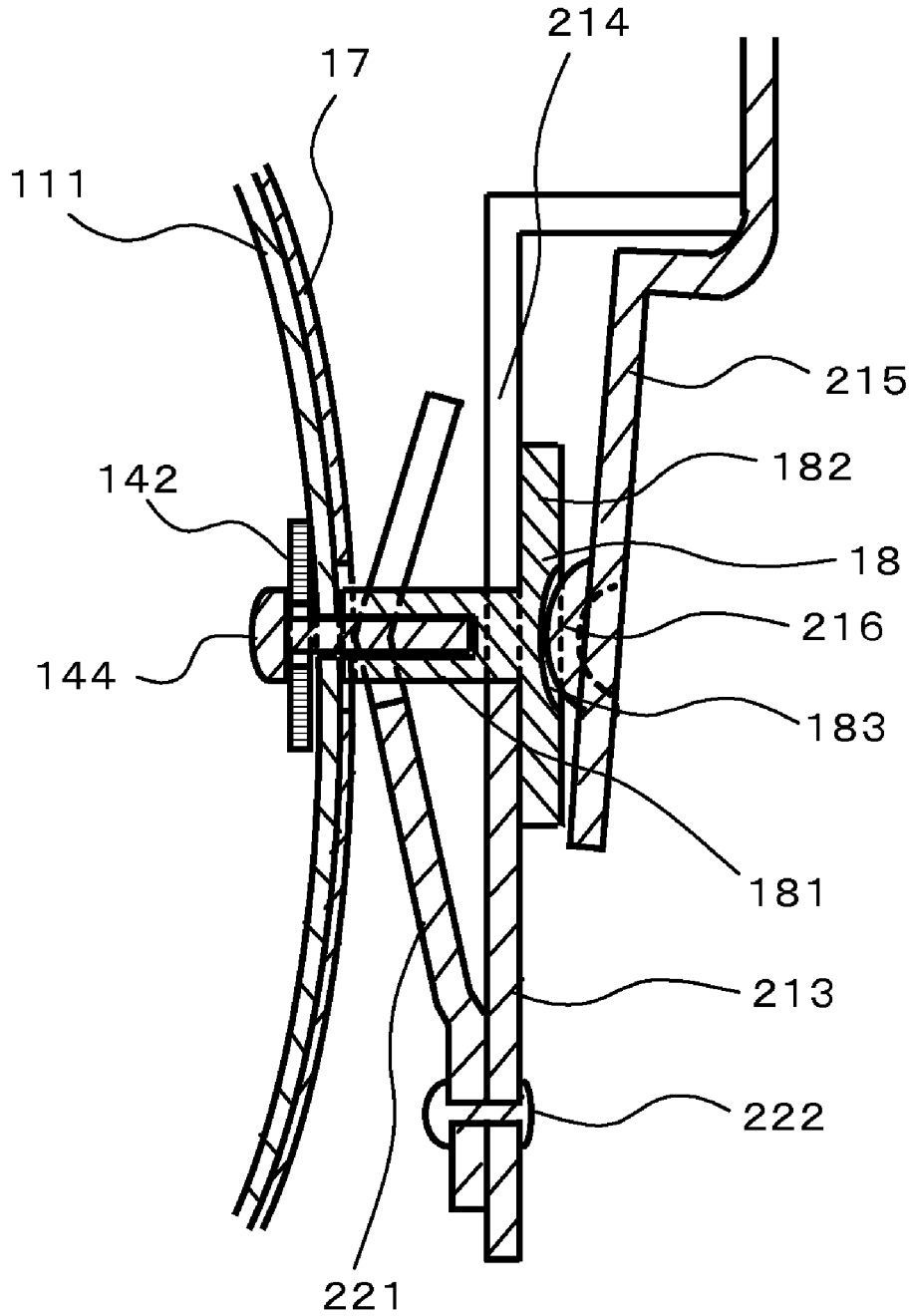
FIG. 4 is a schematic cross-sectional view of major portions along a line I-I in FIG. 3 when the microphone according to the first embodiment is handed on the hanger hook.

The base portion 21 formed of a conductive material has two fixing faces 211 for fixing the hanger hook 2, and a protruding face 212 provided between the two fixing faces 211 and protruding from the fixing face 211 and being U-shaped in a vertical section. The protruding face 212 has a U-shaped notch 214 formed across a hanger face 213 protruding from the fixing face 211. The base portion 21 has a first elastic member 215 integral with the base portion 21. The first elastic member 215 extends from the hanger hook fixing face 211 to the notch 214 inwardly of the protruding face 212. The first elastic member 215 has a protrusion 216 formed at the leading end thereof, and as shown in FIG. 4, the protrusion 216 engages with the recess 183 formed at the flange portion 182 of the hanger knob 18. Further, each of the two fixing faces 211 has a hole 217 for fixing the hanger hook 2.

The spring portion 22 is formed of a conductive material, and fixed to the hanger face 213 using a rivet 222. The spring portion 22 has two protruding portions 221 provided in such a way that there is a clearance with the fixing face 211 and the notch 214 is positioned between the two protruding portions 221. Further, the protruding portions 221 are bent in a direction apart from the hanger face 213 in a shape like letter V.

FIG. 4 is a cross-sectional view of major portions along a line I-I in FIG. 3 when the microphone 1 is hanged on the hanger hook 2. As shown in FIG. 4, the hanger knob 18 provided at the rear face of the microphone 1 is hooked in such a manner as to contact the lowest end of the notch 214. Then, because of the repulsive force of the first elastic member 215 and engagement of the recess 183 formed at the flange portion 182 and the protrusion 216 at the leading end of the first elastic member 215, the microphone 1 is firmly caught. Further, the portions of the two second elastic members 221 of the hanger hook 2 and bent in a shape like letter V are arranged in a line with the hanger knob 18 pushed back by the first elastic member 215, and pushes back the hanger plate 17. Accordingly, the microphone 1 can be firmly hanged on the hanger hook 2, and can be held at three points with uniform forces. Therefore, even if the microphone 1 is vibrated or rotated, the possibility that the microphone 1 is released from the hanger hook 2 is little.

Next, an explanation will be given of the operation of a microphone hanger switch according to this embodiment. When the microphone 1 is hanged on the hanger hook 2, the second elastic members 221 contact the hanger plate 17. Then, the hanger knob 18 is electrically connected to the hanger plate 17 via the hanger hook 2. The circuit board 14 is electrically connected to the hanger knob 18 via the screw 144, the lug terminal 142 and the hanger line 143. Further, the circuit board 14 is electrically connected to the hanger plate 17 via the screws 15, 16 and the weight 13.

Figure 5:
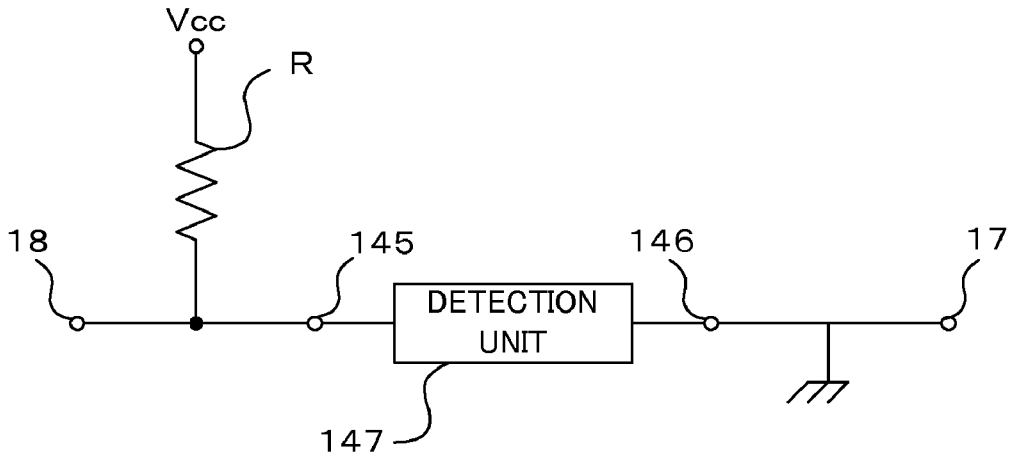
FIG. 5 is a circuit diagram showing the circuit board of the microphone according to the first embodiment.

Here, as shown in FIG. 5, in the circuit board 14, the hanger plate 17 is grounded, and the hanger knob 18 is subjected to pull-up by resistors R. Moreover, the circuit board 14 has a detection unit 147 connected to the first contact point 145 and the second contact point 146.

In a case where the microphone 1 is released from the hanger hook 2, the first contact point 145 is subjected to pull-up by the resistors R, and the second contact point 146 is grounded. Accordingly, by detecting a power-source voltage $V_{cc}$ at the first contact point 145, the detection unit 147 can detect a condition where the microphone 1 is released from the hanger hook 2. In a case where the microphone 1 is hanged on the hanger hook 2, the first contact point 145 and the second contact point 146 are grounded. Accordingly, by detecting a ground voltage $V_{gnd}$ at the first contact point 145, the detection unit 147 can detect a condition where the microphone 1 is hanged on the hanger hook 2. The detection unit 147 transmits a signal, indicating a detected condition, to a non-illustrated communication device main body via the connector 141 and the cord 3.

As explained above, according to this embodiment, by causing the hanger knob 18, which is not electrically connected to the hanger plate 17, to be electrically connected via the hanger hook 2, it is possible to detect that the microphone 1 is hanged on the hanger hook 2. Accordingly, it is possible to omit a wiring for grounding the hanger hook 2. Moreover, as explained above, the second elastic members 221 has portions bent in a shape like letter V and pushing back the hanger plate 17. Further, such portions bent in a shape like letter V are arranged in a line with the hanger knob 18 pushed back by the first elastic member 215, and contact the hanger plate 17. Accordingly, the microphone 1 can be firmly hanged on the hanger hook 2, and can be held at three points with uniform forces. Therefore, even if the microphone 1 is vibrated or rotated, the electrical connection achieved by the hanger plate 17 which contacts the hanger hook 2, and the electrical connection achieved by the hanger knob 18 which contacts the hanger hook 2 can be stably maintained.

Moreover, in this embodiment, because the hanger plate 17 is flat, a user does not have a feeling of a foreign body when he/she holds the microphone 1 with a hand in comparison with a case where the hanger plate has a protrusion, and the limitation of the degree of freedom of designing is little.

Note that in this embodiment, the spring portion 22 acquired by performing bending work on an elastic tabular member notched in a shape like letter U is fixed to the base portion 21 using the rivet 222. The second elastic members 221 contacts the hanger plate 17 via portions bent in a shape like letter V. The second elastic members 221 may be formed in a semi-spherical shape acquired by performing an extrusion work on a tabular member, and may contact the hanger plate 17 point to point. Moreover, the second elastic members 221 may be formed by cutting out a member in a shape like letter U so that a U-shaped notch 213 is positioned therebetween, and performing an extrusion work on the internal portion of the U-shaped portion. Accordingly, the hanger hook 2 can be formed from one tabular member, and it is possible to omit the rivet 222 to fix the spring portion 22. Moreover, the spring portion 22 may be fixed to the base portion 21 by welding.

Moreover, in this embodiment, in the circuit board 14, the hanger plate 17 may be subjected to pull-up by resistors R, and the hanger knob 18 be grounded. In a case where the microphone 1 is released from the hanger hook 2, the first contact point 145 is grounded, and the second contact point 146 is subjected to pull-up by the resistors R. Accordingly, by detecting a power-source voltage $V_{cc}$ at the second contact point 146, the detection unit 147 can detect a condition where the microphone 1 is released from the hanger hook 2. In a case where the microphone 1 is hanged on the hanger hook 2, the first contact point 145 and the second contact point 146 are grounded. Accordingly, by detecting a ground voltage $V_{gnd}$ at the second contact point 146, the detection unit 147 can detect a condition where the microphone 1 is hanged on the hanger hook 2.

Second Embodiment

The external contour of a microphone according to the second embodiment can be shown in FIG. 1 like the microphone of the first embodiment, so that the detailed explanation of the external contour of the microphone will be omitted.

Figure 6:
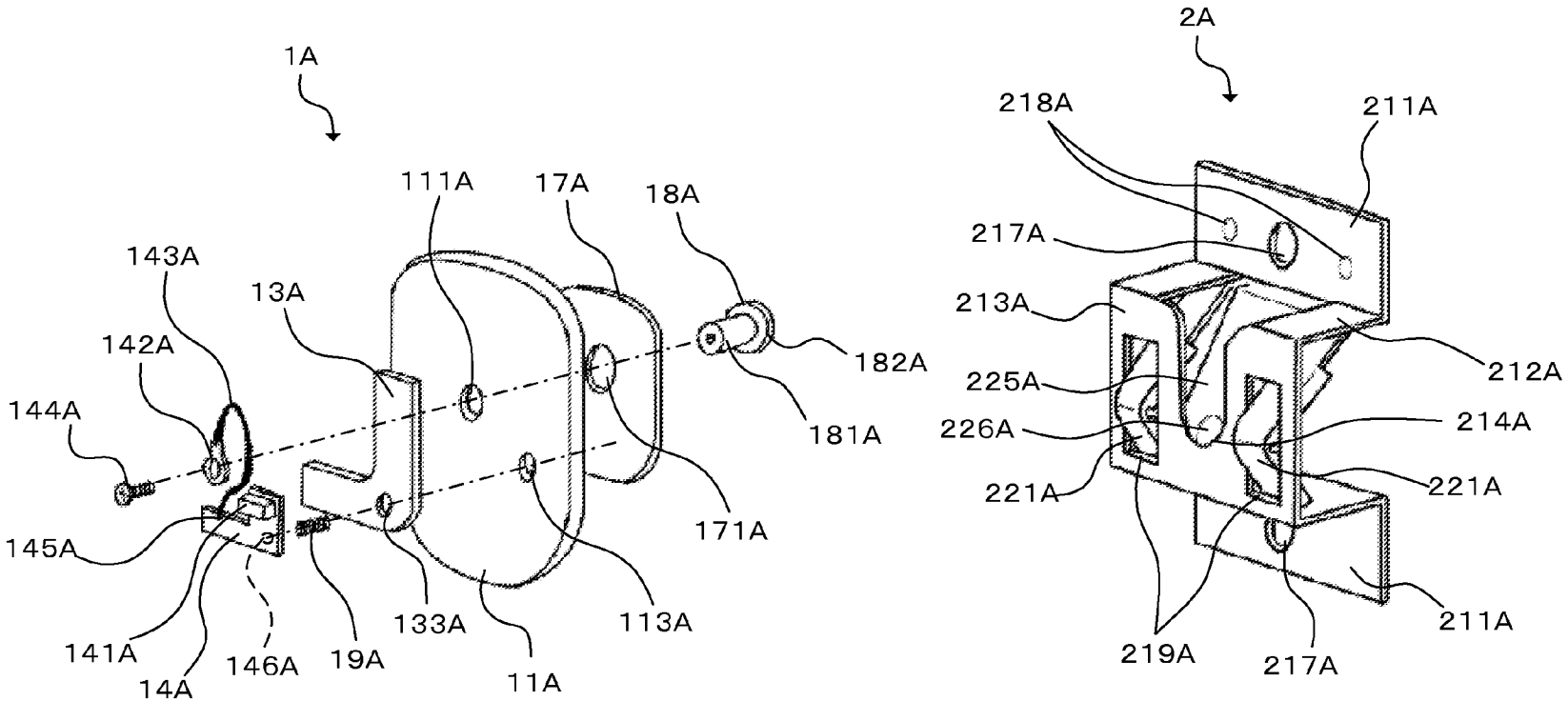
FIG. 6 is a perspective view showing a microphone and a hanger hook according to a second embodiment.

FIG. 6 is a perspective view showing an exploded microphone and a hanger hook according to the second embodiment.

First, the structure of a microphone 1A will be explained. As shown in FIG. 6, the microphone 1A without a front casing 12A has a rear casing 11A, a weight 13A, a circuit board 14A, a spring 19A, a hanger plate 17A, and a hanger knob 18A.

The rear casing 11A is formed of a non-conductive material, and has a hole 111A where a screw 144A to be discussed later is inserted and a hole 113A where the spring 19A is inserted.

The weight 13A is formed of a tabular metal. The weight 13A is provided to accomplish a massive feeling, and is attached to the front face of the rear casing 11A. The weight 13A has a hole 133A where the spring 19A is inserted.

The circuit board 14A is attached to the rear casing 11A via the weight 13A. The circuit board 14A has a connector 141A to be connected to an external power source and to transmit a signal from the microphone. A lug terminal 142A is electrically connected to a first contact point 145A of the circuit board 14A via a hanger line 143A. Further, the conductive screw 144A to be inserted in the lug terminal 142A is inserted in the hole 111A of the rear casing 11A, and is threaded with the hanger knob 18A. Accordingly, the lug terminal 142A is electrically connected to the hanger knob 18A. Moreover, a second contact point 146A which constitutes a part of a hanger-switch circuit is formed on the rear face of the circuit board 14A by a soldering film or the like.

The spring 19A is a conductive coil spring. The spring 19A is inserted in the hole 133A of the weight and the hole 113A of the rear casing 11A. The spring 19A becomes a compressed condition when the circuit board 14A is attached to the rear casing 11A. The front end of the spring 19A pushes the second contact point 146A located at the rear face of the circuit board 14A, and the rear end of the spring 19A pushes the front face of the hanger plate 17A. Accordingly, the second contact point 146A is electrically connected to the hanger plate 17A via the spring 19A.

The hanger plate 17A is formed of a flat conductive material, and is attached to the rear face of the rear casing 11A. The hanger plate 17A has a hole 171A having a larger diameter than the external diameter of a shaft portion 181A of the hanger knob 18A. The hole 171A is located at a position which overlaps the hole 111A of the rear casing 11A when the hanger plate 17A is attached to the rear casing 11A.

The hanger knob 18A is made of metal, and has the shaft portion 181A, and a flange portion 182A facing the hanger plate 17A. The external diameter of the shaft portion 181A is smaller than the diameter of the hole 171A of the hanger plate 17A, so that the hanger knob 18A is inserted in the hole 171A without contacting the hanger plate 17A. Accordingly, the hanger knob 18A is electrically isolated from the hanger plate 17A, and is fixed to the rear face of the rear casing 11A by the screw 144A. The flange portion 182A has a recess 183A which engages with a protrusion 226A formed at a first elastic member 225A of the hanger hook 2A to be discussed later.

Figure 7:
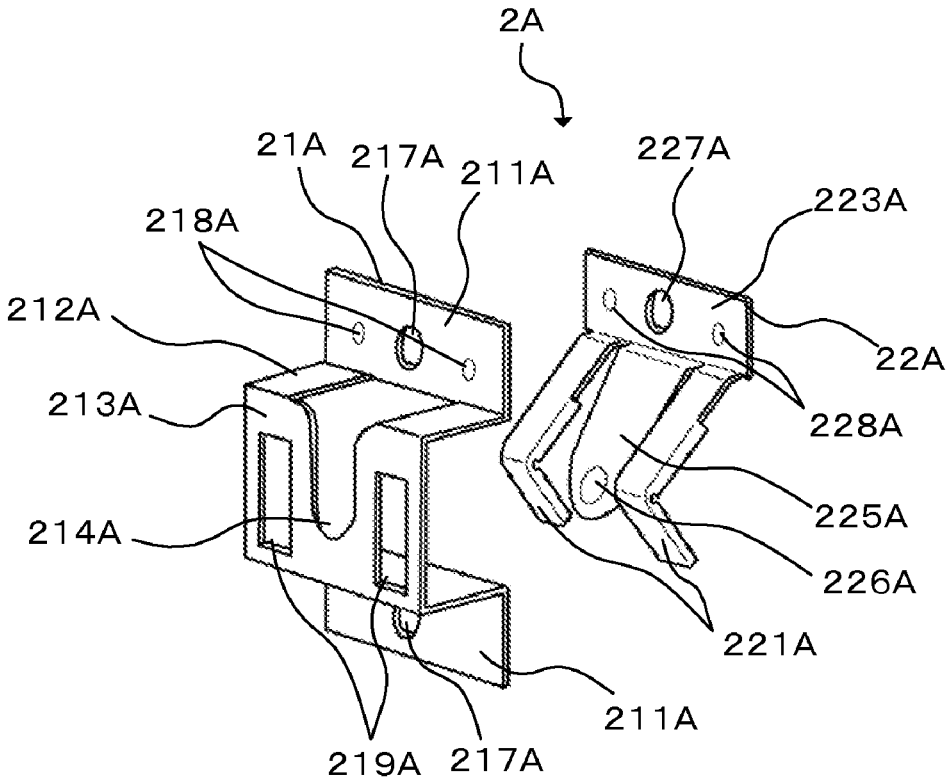
FIG. 7 is a perspective view showing the exploded hanger hook according to the second embodiment.
Figure 8:
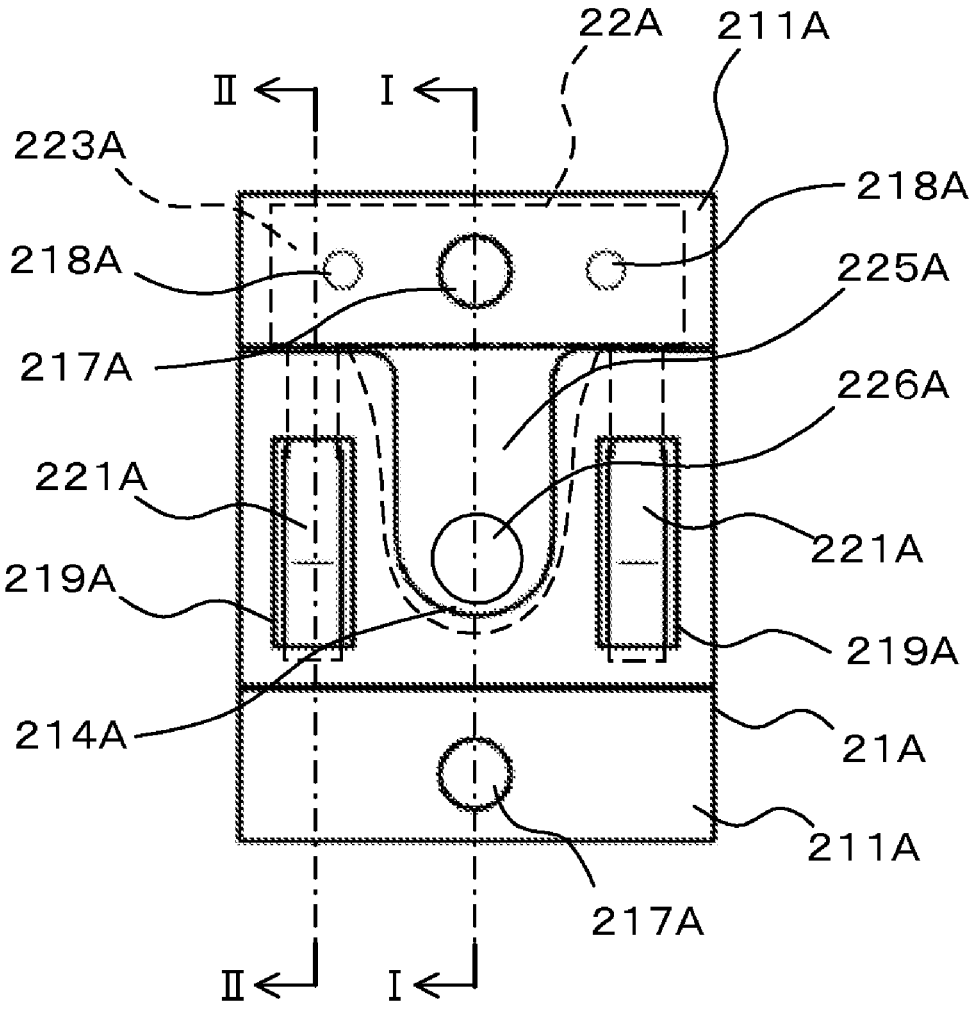
FIG. 8 is a front view showing the hanger hook according to the second embodiment.

Next, the structure of the hanger hook 2A will be explained. FIG. 7 is a perspective view showing an exploded hanger hook 2A, and FIG. 8 is a front view of the assembled hanger hook 2A. As shown in FIGS. 6, 7, and 8, the hanger hook 2A has a base portion 21A and a spring portion 22A.

The base portion 21A formed of a conductive material has two fixing faces 211A for fixing the hanger hook 2A, and a protruding face 212A provided between the two fixing faces 211A and protruding from those fixing faces 211A and being U-shaped in a vertical section. The protruding face 212A has a U-shaped notch 214A formed across a hanger face 213A protruding from the fixing face 211A. Moreover, the hanger face 213A has two rectangular hole 219A where second elastic members 221A protrude, in such a way that the U-shaped notch 214A is positioned between the two rectangular holes 219A. Further, each of the two fixing faces 211A has a hole 217A for fixing the hanger hook 2. An upper face among the two fixing faces 211A has protrusions 218A protruding toward the rear face.

The spring portion 22A formed of a conductive material has a fixing face 223A for fixing the hanger hook 2A, the first elastic member 225A, and two second elastic members 221A sandwiching the first elastic member 225A, all integrally formed one another. The fixing face 223A has a hole 227A for fixing the hanger hook 2A. Moreover, the fixing face 223A has two holes 228A where the protrusions 218A of the base member 21A respectively engage. As the protrusions 218A respectively engage with the holes 228A, the base portion 21A and the spring portion 22A can be assembled together correctly. The first elastic member 225A extends from the fixing face 223A toward the hanger face 213A, and has a protrusion 226A formed at the leading end. The second elastic members 221A extend from the fixing face 223A toward the hanger face 213A, and are bent at a predetermined position so as to be in a shape like letter V.

The hanger hook 2A is assembled by causing the protrusions 218A of the base portion 21A to engage with the respective holes 228A of the spring portion 22A. Moreover, non-illustrated screws are inserted in the holes 217A and the holes 227A, so that the hanger hook 2A can be fixed to a wall or the like. The first elastic member 225A is positioned inside a space formed by the protruding face 212A. The portions of the second elastic members 221A bent in a shape like letter V protrude from the respective holes 219A of the hanger face 213A, and the leading ends of the respective second elastic members 221A are positioned inside a space formed by the protruding face 212A.

Figure 9A:
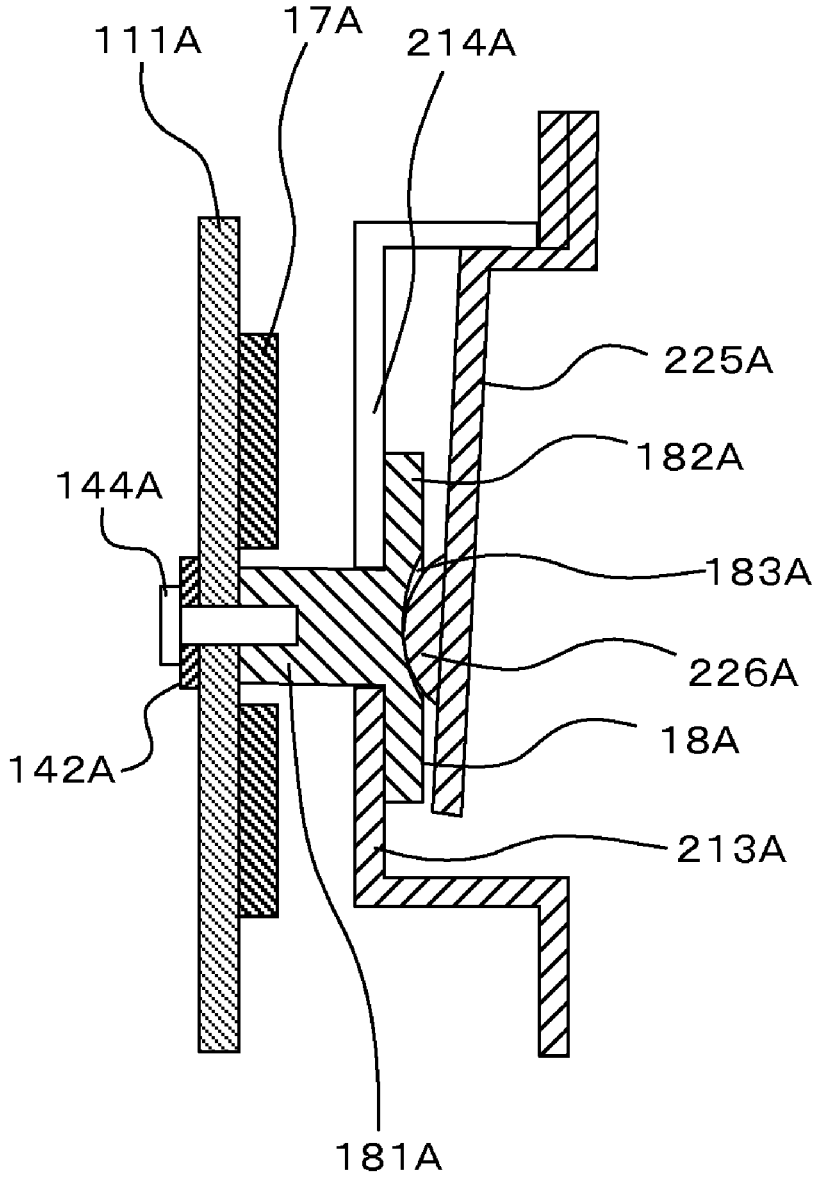
FIG. 9A is a schematic cross-sectional view of major portions along line I-I in FIG. 8 when the microphone according to the second embodiment is hanged on the hanger hook.
Figure 9B:
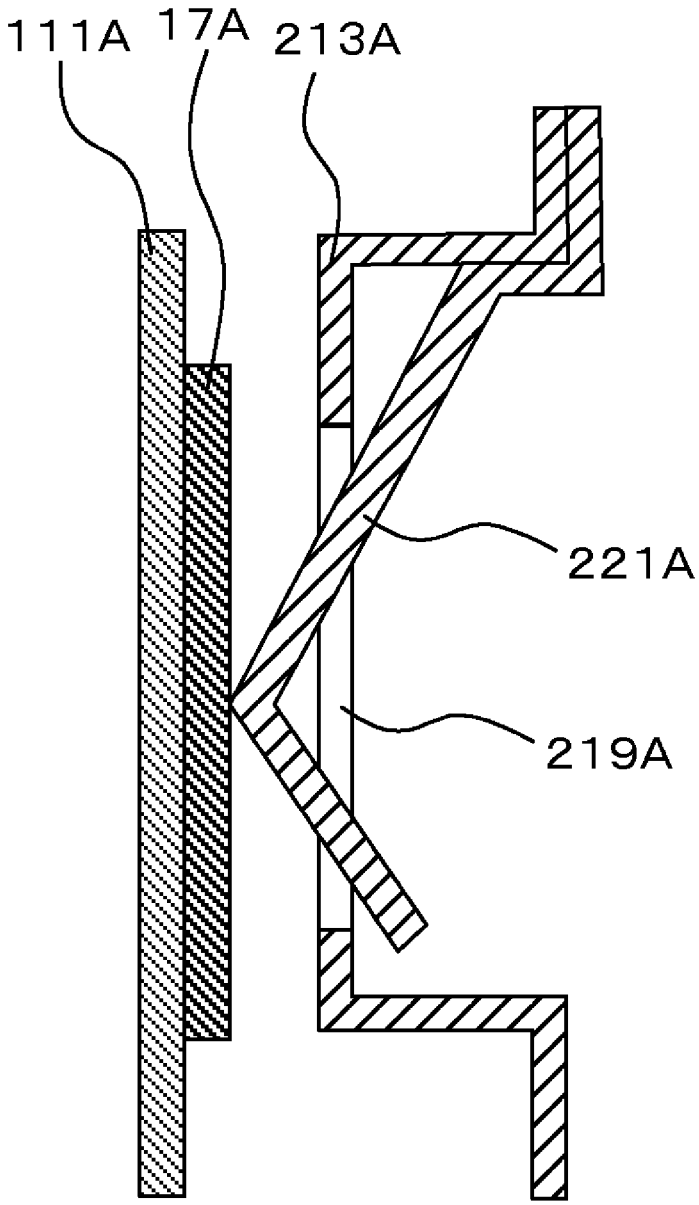
FIG. 9B is a schematic cross-sectional view of major portions along line II-II in FIG. 8 when the microphone according to the second embodiment is hanged on the hanger hook.

FIG. 9A is a cross-sectional view of major portions along a line I-I in FIG. 8 when the microphone 1A is hanged on the hanger hook 2A, and FIG. 9B is a cross-sectional view of major portions along a line II-II when the microphone 1A is hanged on the hanger hook 2A. As shown in FIG. 9A, the hanger knob 18A provided at the rear face of the microphone 1A is caused to contact the lowest end of the notch 214A. Then, because of the repulsive force of the first elastic member 225A and engagement of the recess 183A, formed at the flange portion 182A, and the protrusion 226A, formed at the leading end of the first elastic member 225A, the microphone 1A is firmly caught. Further, as shown in FIG. 9B, the portions of the second elastic members 221A of the hanger hook 2A bent in a shape like letter V push back the hanger plate 17A by repulsive force. The bent portions of the second elastic members 221A are arranged in a line with the hanger knob 18A pushed back by the first elastic member 225A, and push back the hanger plate 17A. Accordingly, the microphone 1A can be firmly hanged on the hanger hook 2A, and can be held at three points with uniform forces. Therefore, even if the microphone 1A is vibrated or rotated, the possibility that the microphone 1A is released from the hanger hook 2A is little.

Next, the operation of a microphone hanger-switch of this embodiment will be explained. As the microphone 1A is hanged on the hanger hook 2A, the second elastic members 221A contact the hanger plate 17A. Then, the hanger knob 18A is electrically connected to the hanger plate 17A via the hanger hook 2A. The circuit board 14A is electrically connected to the hanger knob 18A via the screw 144A, the lug terminal 142A, and the hanger line 143A. Further, the circuit board 14A is electrically connected to the hanger plate 17A via the spring 19A. Then, through detection means, which is the same as that of the first embodiment, it is possible to detect a condition whether or not the microphone 1A is hanged on the hanger hook 2A.

According to this embodiment, by causing the hanger knob 18A, which is not electrically connected to the hanger plate 17A, to be electrically connected via the hanger hook 2A, it is possible to detect that the microphone 1A is hanged on the hanger hook 2A. Accordingly, it is possible to omit a wiring for grounding the hanger hook 2A. Moreover, as explained above, the portions of the second elastic members 221A bent in a shape like letter V push back the hanger plate 17A. Further, the portions bent in a shape like letter V are arranged in a line with the hanger knob 18A pushed back by the first elastic member 225A, and contact the hanger plate 17A. Accordingly, the microphone 1A can be firmly hanged on the hanger hook 2A, and can be held at three points with uniform forces. Therefore, even if the microphone 1A is vibrated or rotated, the electrical connection of the hanger plate 17A which contacts the hanger hook 2A and the electrical connection of the hanger knob 18A which contacts the hanger hook 2A can be stably maintained.

Moreover, according to this embodiment, because the hanger plate 17A is flat, a user does not have a feeling of a foreign body when he/she holds the microphone 1A with a hand in comparison with a case where the hanger plate has a protrusion, and the limitation of the degree of freedom of designing is little.

Further, according to this embodiment, the supporting point of the second elastic members 221A is located at the rear of the hanger face 213A. Accordingly, in comparison with the first embodiment where the second elastic members 221 are disposed ahead of the hanger face 213 and the supporting point of the second elastic members 221 is located ahead of the hanger face 213, the movable range of the second elastic members 221A can be wide. This facilitates adjustment of force that the second elastic members 221A push the hanger plate 17A.

Still further, according to this embodiment, only portions of the second elastic members 221A which are bent in a shape like letter V protrude from the respective holes 219A of the hanger face 213A. Accordingly, the end portions of the second elastic members 221A are not exposed, so that a hand is not damaged when the microphone 1A is hanged on the hanger hook 2A or when the hanger hook 2A is disposed.

Note that in this embodiment, as explained above, the base portion 21A and the spring portion 22A are assembled together by causing the protrusions 218A of the base portion 21A to engage with the respective holes 228A of the spring portion 22A. However, the base portion 21A and the spring portion 22A may be assembled by threading screws formed at the base portion 21A and the spring portion 22A, respectively.

Various embodiments and changes may be made thereunto without departing from the broad spirit and scope of the invention. The above-described embodiments are intended to illustrate the present invention, not to limit the scope of the present invention. The scope of the present invention is shown by the attached claims rather than the embodiments. Various modifications made within the meaning of an equivalent of the claims of the invention and within the claims are to be regarded to be in the scope of the present invention.

What is claimed is:

1. A microphone comprising:

a non-conductive microphone casing;

a conductive hanger plate provided on the external face of the microphone casing;

a conductive hanger knob provided at the microphone casing so as to be electrically isolated from the hanger plate;

a conductive hanger hook for hanging the microphone casing via the hanger knob;

a hanger member having a notch that catches the hanger knob together;

a first elastic member that urges the hanger knob caught by the notch in a direction pushing back toward the hanger member; and a second elastic member that urges the hanger plate in a direction apart from the hanger member when the hanger knob is caught by the notch.

2. The microphone according to claim 1, wherein the second elastic member is so provided as to protrude from a hole formed in the hanger member, and contacts the hanger plate via the hole.

3. The microphone according to claim 1, wherein the first and second elastic members are respectively conductive blade springs.

4. The microphone according to claim 3, wherein the hanger knob has a recess formed at the leading end, and the blade spring constituting the first elastic member has a protrusion that engages with the recess.

5. The microphone according to claim 1, further comprising:

a circuit board provided inside the microphone casing;

a first conductive member that electrically connects the hanger knob and a first contact point on the circuit board; and a second conductive member that electrically connects the hanger plate and a second contact point on the circuit board.

6. The microphone according to claim 5, wherein the circuit board has a determination unit that determines whether or not the microphone is hanged on the hanger knob on the basis of the voltage at the first contact point or the voltage at the second contact point.

7. The microphone according to claim 5, wherein the first conductive member comprises:

a wiring that connects the first contact point of the circuit board and a terminal provided inside the microphone casing; and a conductive screw that connects the terminal and the hanger knob as the screw is fastened with the hanger knob via a hole provided in the microphone casing.

8. The microphone according to claim 5, wherein the second conductive member comprises:

a conductive weight provided inside the microphone casing;

a first conductive screw that connects the circuit board and the weight as the first screw is fastened with the weight via a screw hole provided in the second contact point of the circuit board; and a second conductive screw that connects the hanger plate and the weight as the second screw is fastened with the weight via a screw hole provided in the hanger plate and a hole provided in the microphone casing.

9. The microphone according to claim 5, wherein the second conductive member is a conductive spring that passes all the way through a hole formed in the microphone casing, and when the spring is compressed, one end of the spring abuts the second contact point of the circuit board, and the other end abuts the hanger plate.

10. A conductive microphone hanger-hook for hanging a microphone via a hanger knob and for electrically connecting the hanger knob and a hanger plate disposed at the microphone, the hanger hook comprising:

a hanger member having a notch that catches the hanger knob together;

a first elastic member that urges the hanger knob caught by the notch in a direction pushing back toward the hanger member; and a second elastic member that urges the hanger plate in a direction apart from the hanger member when the hanger knob is caught by the notch.

11. The microphone hanger-hook according to claim 10, wherein the second elastic member is so disposed as to protrude from a hole formed in the hanger member, and contacts the hanger plate via the hole.

* * * * *